US010123606B1

(12) United States Patent
Krok et al.

(10) Patent No.: US 10,123,606 B1
(45) Date of Patent: Nov. 13, 2018

(54) CONTAINER FOR REMOVABLY RETAINING A RAZOR CARTRIDGE WITH RAZORBLADES INCLUDING A ZINC STRIP AND A CENTRAL STABILIZER WITH A TAB AND WINGS TO PROVIDE AN EVENLY DISTRIBUTED DOWNWARD FORCE IN THE DIRECTION OF THE ZINC STRIP

(71) Applicants: Paul Krok, Culver City, CA (US); Brian Steinhobel, Sandton (ZA)

(72) Inventors: Paul Krok, Culver City, CA (US); Brian Steinhobel, Sandton (ZA)

(73) Assignee: Bonfit America Inc., Culver City, CA (US)

( * ) Notice: Subject to any disclaimer, the term of this patent is extended or adjusted under 35 U.S.C. 154(b) by 0 days.

(21) Appl. No.: 15/800,889

(22) Filed: Nov. 1, 2017

(51) Int. Cl.
*A45D 27/22* (2006.01)
*B65D 25/10* (2006.01)
*B65D 8/00* (2006.01)

(52) U.S. Cl.
CPC ..... *A45D 27/225* (2013.01); *B65D 7/04* (2013.01); *B65D 11/02* (2013.01); *B65D 25/10* (2013.01)

(58) Field of Classification Search
CPC ..... A45D 27/225; A45D 27/22; A45D 27/46; B65D 7/04; B65D 25/10; B65D 11/02; B26B 21/40
USPC ..... 206/352, 354, 356, 208, 349; 30/541, 30/539
See application file for complete search history.

(56) References Cited

U.S. PATENT DOCUMENTS

| | | | | |
|---|---|---|---|---|
| 2,551,859 | A | 5/1951 | Thompson | |
| 3,759,594 | A | 9/1973 | Cobb | |
| 8,113,347 | B2 | 2/2012 | Kohring | |
| 8,342,322 | B2 | 1/2013 | De'Rennaux | |
| 8,757,370 | B2 | 6/2014 | Krok et al. | |
| 8,770,398 | B1 | 7/2014 | Krok et al. | |
| 9,380,850 | B1 | 7/2016 | Krok et al. | |
| 9,581,341 | B1 | 2/2017 | Krok et al. | |
| D791,472 | S * | 7/2017 | Krok | D3/205 |
| 2009/0056151 | A1* | 3/2009 | Kohring | A45D 27/225 30/541 |
| 2009/0057170 | A1* | 3/2009 | Kohring | A45D 27/225 206/228 |
| 2009/0172958 | A1 | 7/2009 | Prudden et al. | |
| 2012/0125793 | A1* | 5/2012 | Benvenuto | A45D 27/24 206/349 |
| 2013/0047860 | A1 | 2/2013 | Lawhorne | |
| 2013/0213829 | A1* | 8/2013 | Krok | A45D 27/225 206/208 |
| 2016/0015147 | A1* | 1/2016 | Lampard | A45D 27/22 206/208 |

* cited by examiner

*Primary Examiner* — Steven A. Reynolds
(74) *Attorney, Agent, or Firm* — Thomas I. Rozsa

(57) ABSTRACT

A container retained in a closed condition by an internal spring force. When the container is in a closed condition, a razorblade cartridge containing at least one razorblade having a sharp front edge faces a zinc strip removably retained within an interior chamber of the container. A convex shape of the zinc strip creates an upward orientation of the zinc strip to enhance contact with the razor blade. A central stabilizer is retained in the interior chamber of the container, the central stabilizer having a downwardly extending tab to provide a downward force on a razorblade cartridge. A pair of oppositely disposed wings on the central stabilizer provides an even distribution of the downward force.

14 Claims, 21 Drawing Sheets

CONTAINER FOR REMOVABLY RETAINING A RAZOR CARTRIDGE WITH RAZORBLADES INCLUDING A ZINC STRIP AND A CENTRAL STABILIZER WITH A TAB AND WINGS TO PROVIDE AN EVENLY DISTRIBUTED DOWNWARD FORCE IN THE DIRECTION OF THE ZINC STRIP

BACKGROUND OF THE INVENTION

1. Field of the Invention

The present invention relates to the field of retainers for retaining a safety razor and with shaving blade cartridge attached to the handle so that the safety razor is in condition for immediate shaving use when it is removed from the container.

2. Description of the Prior Art

The following seven patents and published patent applications are the closest prior art references which were located in a prior art search.

1. U.S. Pat. No. 2,551,859 issued to Marcus C. Thompson on May 8, 1951 for "Razor Supporting Means" (hereafter the "Thompson Patent");
2. U.S. Pat. No. 3,759,594 issued to Jack M. Cobb on Sep. 18, 1973 for "Method and Apparatus for Storing Cutting Implements" (hereafter the "Cobb Patent");
3. United States Published Patent Application No. 2009/0172958 to John Prudden et al. on Jul. 9, 2009 for "Pivot Inhibiting Razor Storage Case" (hereafter the "Prudden Published Patent Application");
4. U.S. Pat. No. 8,113,347 issued to Douglas Robert Kohring et al. on Feb. 14, 2012 for "Razor Storage Case Having Mating Closure Members" (hereafter the "Kohring Patent");
5. U.S. Pat. No. 8,342,322 issued to Darrell R. De'Rennaux on Jan. 1, 2013 for "Razor Bed" (hereafter the "De'Rennaux Patent");
6. United States Published Patent Application No. 2013/0047860 to Charles Allan Lawhorne on Feb. 28, 2013 for "Anti-Rust Case (ARC)" (hereafter the "Lawhorne Published Patent Application");

The Thompson Patent discloses a razor supporting means. This primarily is disclosing a razor supporting structure to enable the razor to dry.

The Cobb Patent discloses the general concept of a container where the razorblades are placed against the substance that will prevent them from corroding and otherwise deteriorating.

The Prudden Published Patent Application discloses a pivot inhibiting razor storage case. The patent application discloses a spring loaded case on a living hinge where the shaver and blades are retained within the case and openings within the case so that a wet razorblade can be dried.

The Kohring Patent discloses a razor storage case having mating closure members with the intent of clearly removing moisture from the razorblade that is contained within the container which also presumably is also attached to a safety razor handle.

The De'Rennaux Patent discloses the concept of having a razor saver that includes an absorbent liner and one or more absorbent desiccant gel packs for removing moisture from the razorblade. The patent discloses the concept of having only the desiccant to remove the moisture.

The Lawhome Published Patent Application discloses an anti-rust case. The patent application discloses: a case which contains oxygen and moisture absorbing desiccant. The desiccant, being activated clay, silica gel, and molecular sieve, is contained inside the case along with products that need to remain free of rust. The main object of the case is to prevent rust from forming on the blades of a manual shaver or straight razor. The main components of this product are the case, which restrict air flow, and the desiccant which absorb oxygen and moisture.

The current inventors are also the co-inventors of four issued United States patents. The first issued patent is U.S. Pat. No. 8,757,370 issued on Jun. 24, 2014 for "Retaining Disposable Shaver Blade Cartridges in a Sealed Condition and Simultaneously Retaining the Shaver Handle in a Condition for Immediate Shaving Use". The second issued patent for which the present inventors are also co-inventors is U.S. Pat. No. 8,770,398 issued on Jul. 8, 2014 for "Retaining Disposable Shaver Blade Cartridges in a Sealed Condition and Simultaneously Retaining the Shaver Handle in a Condition for Immediate Shaving Use" which contains additional information on a desiccant within the container. The third issued patent for which the present inventors are also co-inventors is U.S. Pat. No. 9,380,850 issued on Jul. 5, 2016 for "Safety Razor Holder with Zinc Strip to Reduce Corrosion of the Razor Blades". The fourth issued patent for which the present inventors are also co-inventors is U.S. Pat. No. 9,581,341 issued on Feb. 28, 2017 for "Safety Razor Holder with Zinc Strip to Reduce Corrosion of the Razor Blades and Interior Leaf Spring to Facilitate Retention of the Razor Blade Cartridge Within the Razor Holder".

SUMMARY OF THE INVENTION

The present invention is an improved safety razor holder that includes a removable flexible zinc strip. The improved razor blade zinc strip is an improvement based on the manner in which the zinc strip is affixed to the housing and the concave shape of the zinc strip that forces more contact with the blade portion of the razor during use and storage of the present invention. Optionally, the zinc strip is also removably affixed to the housing. While a user may not ordinarily remove the zinc strip, the removable feature provides the option of replacing the zinc strip with a fresh zinc strip without having to discard the entire container.

A container retained in a closed condition by an internal spring force. When the container is in a closed condition, a razorblade cartridge containing at least one razorblade having a sharp front edge faces a zinc strip removably retained within an interior chamber of the container. A convex shape of the zinc strip creates an upward orientation of the zinc strip to enhance contact with the razor blade. A central stabilizer is retained in the interior chamber of the container, the central stabilizer having a downwardly extending tab to provide a downward force on a razorblade cartridge. A pair of oppositely disposed wings on the central stabilizer provides an even distribution of the downward force. Optionally, the zinc strip can be removably retained within an interior chamber of the container.

It is an object of the present invention to have a housing affixed within the container that contains a central stabilizer having a left wing and a right wing that assists in retaining multiple shaped and sized razorblades to the zinc strip. It is also within the spirit and scope of the present invention to have a removably affixed housing within the container that contains a central stabilizer having a left wing and a right wing that assists in retaining multiple shaped and sized razorblades to the zinc strip.

The improved safety razor holder is a spring-biased container where the spring keeps the container closed and it is necessary to provide a force that overcomes the spring force to open the container so that the handle and attached razorblade cartridge with at least one razorblade can be removed from the container which then snaps shut due to the closing spring force. When used throughout this patent application, this improved apparatus which provides the closing spring force is generally referred to as a closing force member. The closing force is created by spring members selected from the group consisting of a coil spring assembly and a leaf spring assembly. The safety razor with at least one razorblade with the sharp edge is ready for use.

It is within the spirit and scope of the present invention for improved safety razor holder to retain any multiplicity of razorblades, with each respective razorblade having a sharp edge either forced to be against the zinc metal strip or adjacent the zinc metal strip. The upper housings left wing and a right wing are positioned in the container so that the downward force generated from the spring is applied evenly across the upper surface of the razor blade head to better retain the head in position when the container is in the closed position.

It is therefore an object of the present invention to provide an improved spring-biased closed container which contains a closing force member, two wings for improved versatility and compatibility with numerous razorblades shapes and sizes, and a removably affixed convex zinc strip.

It is a further object of the present invention to provide a container which has drain holes that allows the container to not retain water. By not retaining water, the present invention improves safety razor holder will assist in keeping the razor blade dry to minimize corrosion due to moisture during the storage process.

It is a further object of the present invention to provide a zinc strip within the interior chamber of the container with a spring biasing force causing the container to remain closed and also forcing the cartridge containing the razorblades to be in contact with or adjacent the zinc strip. In addition, the container retains the razorblade cartridge and attached handle in an in-use condition, so that the safety razor can be used for shaving purposes without having to hand touch the razorblades or the cartridges and accidently cut a finger.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
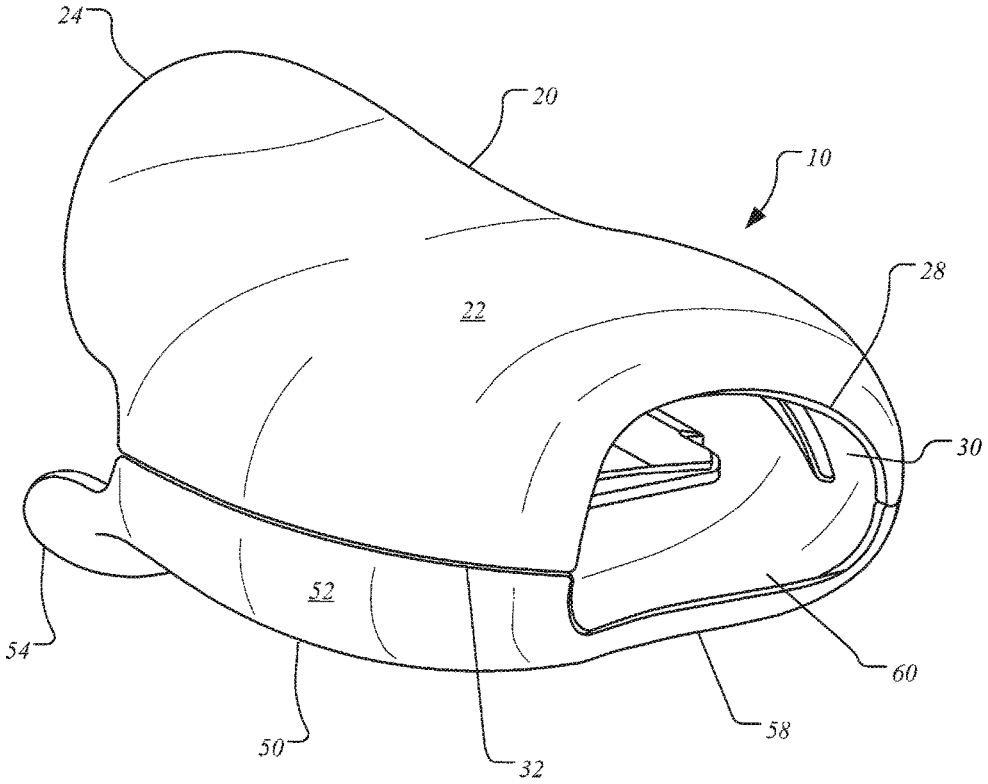
FIG. 1 is an exterior top-front perspective view of the present invention improved safety razor holder with removable convex zinc strip and removable upper housing with wings to better retain numerous shapes and sized razor blades.
Figure 2:
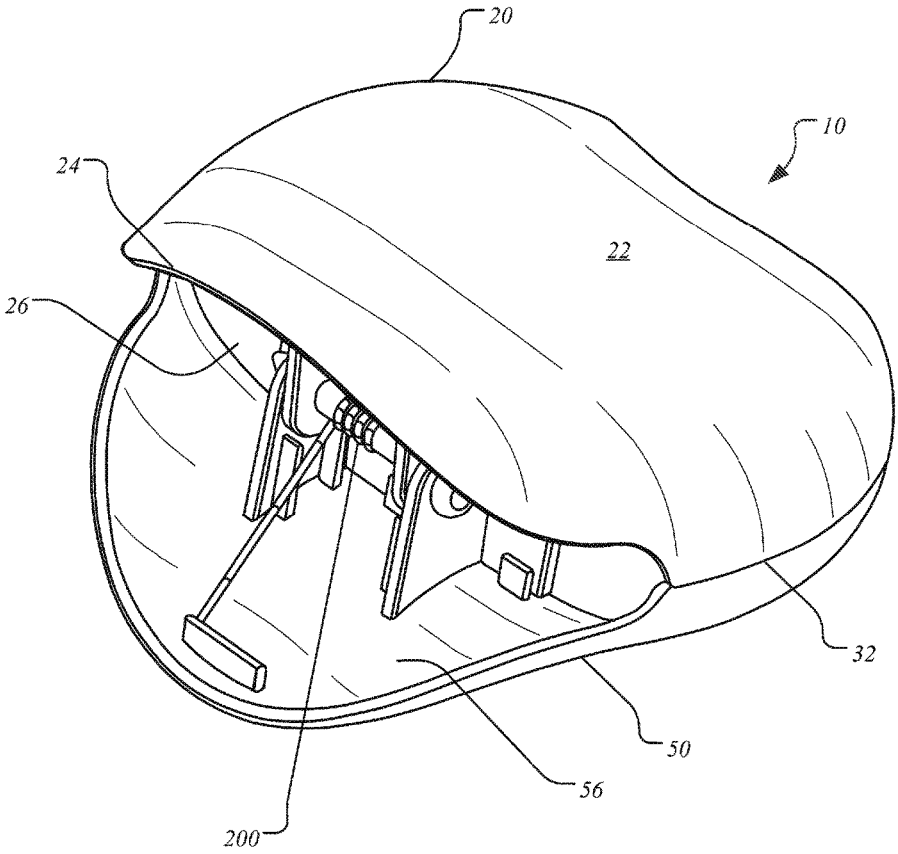
FIG. 2 is an exterior top rear perspective view of the present invention container.
Figure 3:
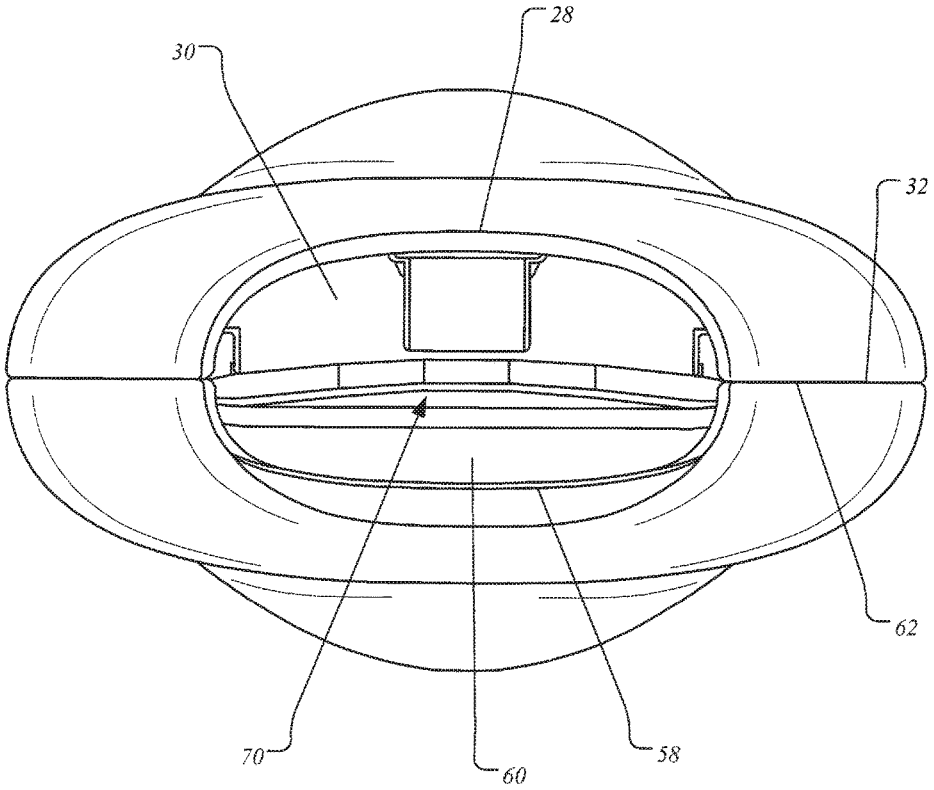
FIG. 3 is an exterior front view of the present invention improved safety razor holder.
Figure 4:
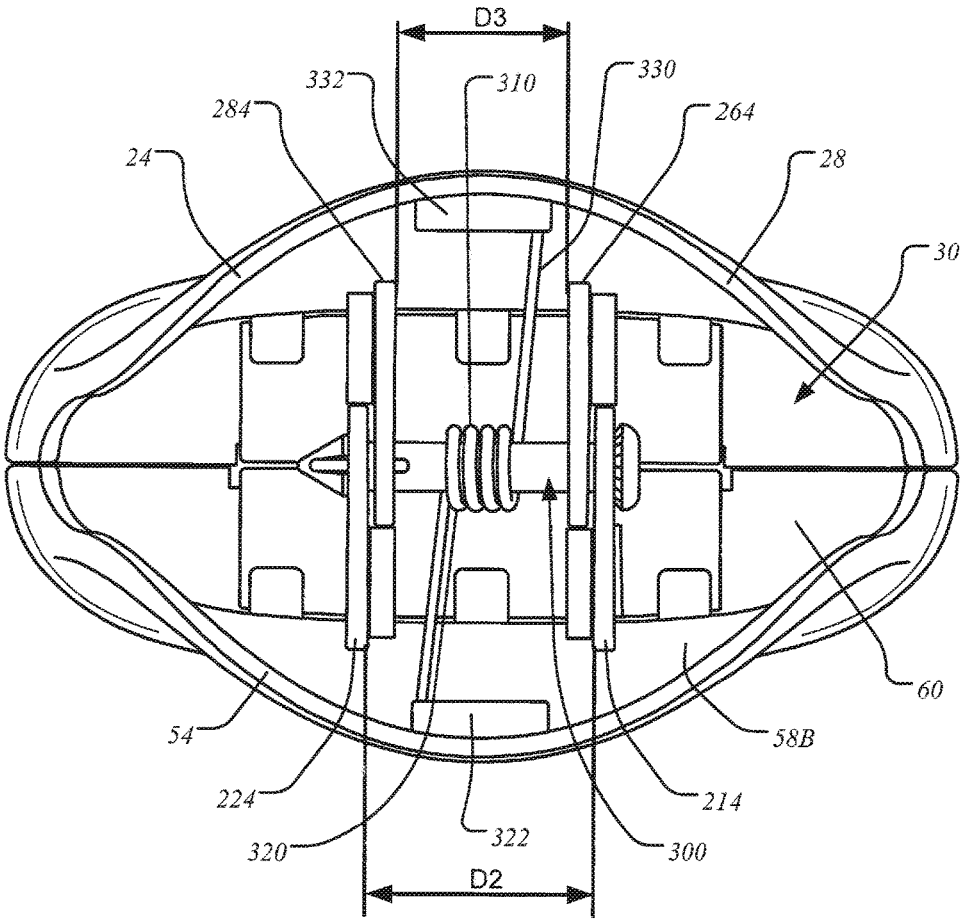
FIG. 4 is an exterior rear view of the present invention improved safety razor container.
Figure 5:
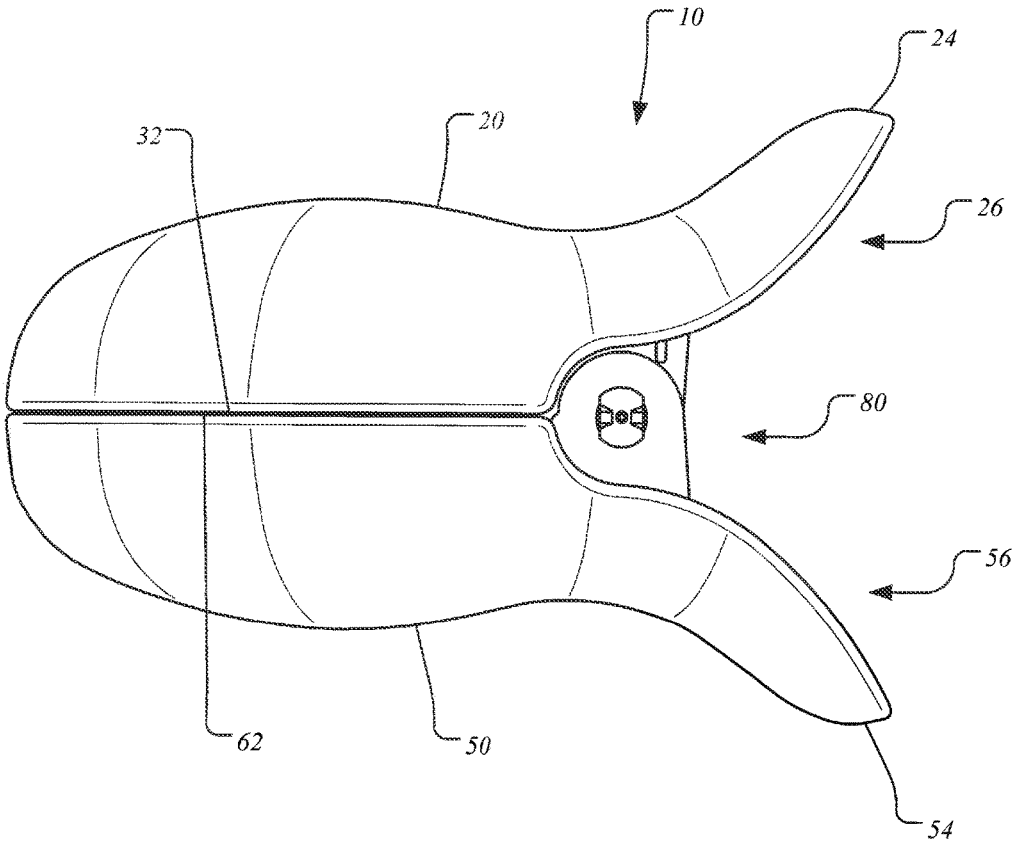
FIG. 5 is an exterior left side view of the present invention improved safety razor container.
Figure 6:
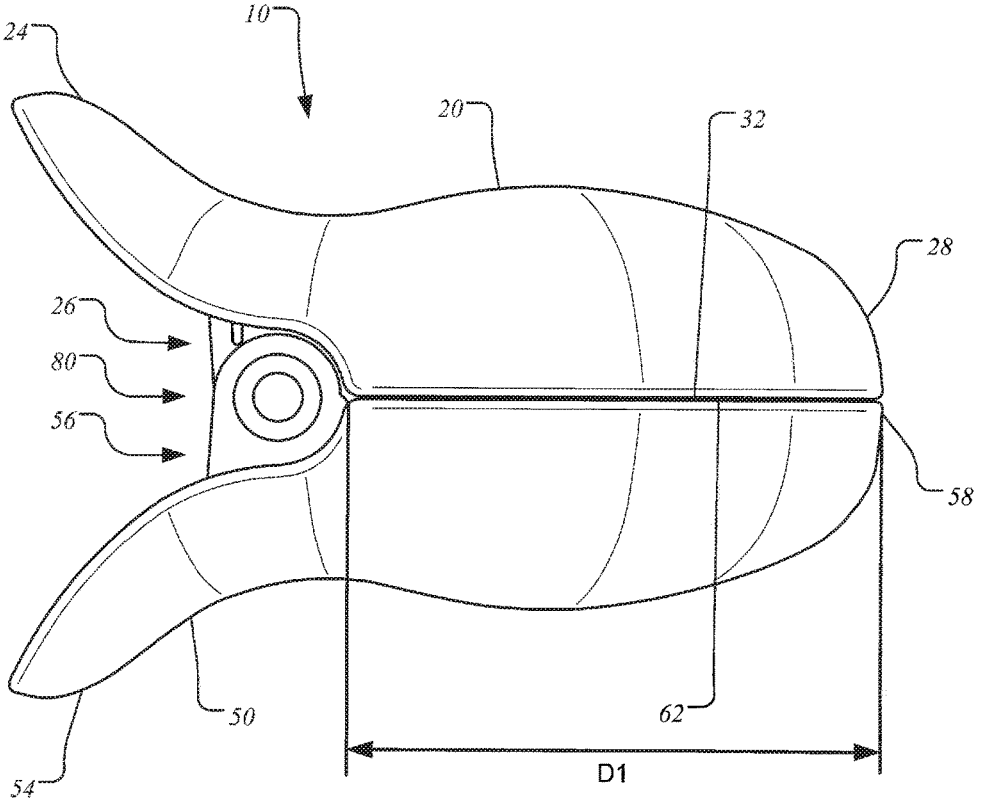
FIG. 6 is an exterior right side view of the present invention improved safety razor container.
Figure 7:
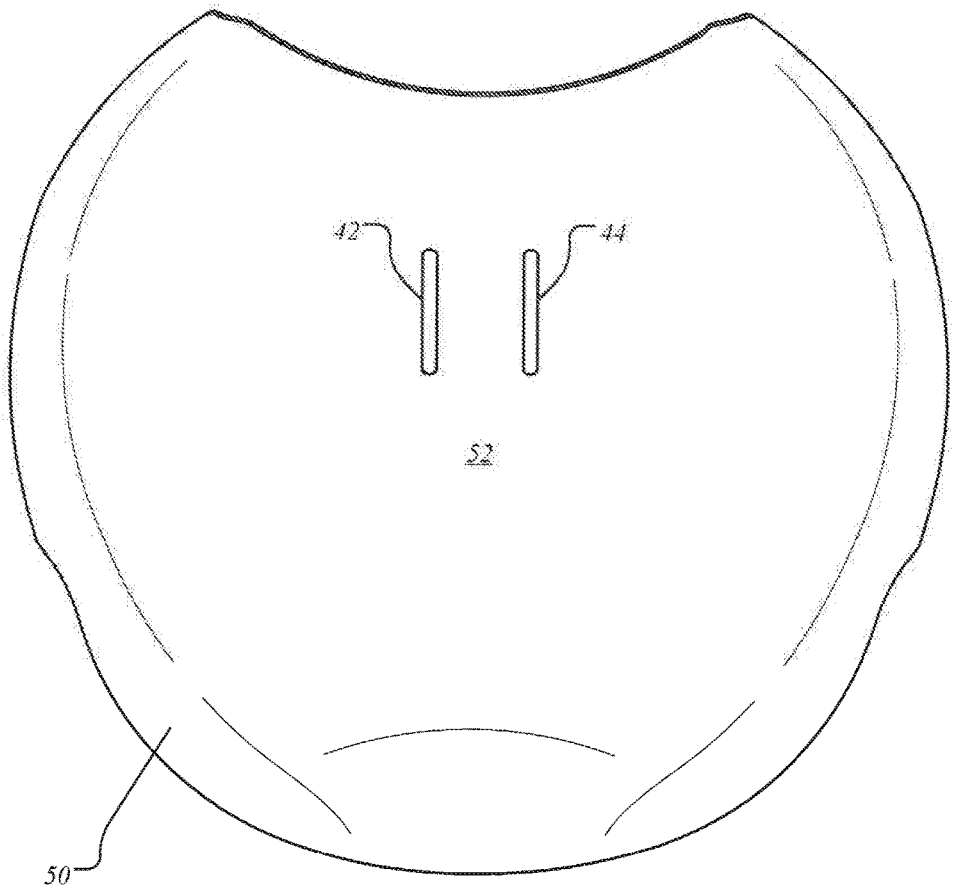
FIG. 7 is an exterior bottom plan view of the present invention improved safety razor container.
Figure 8:
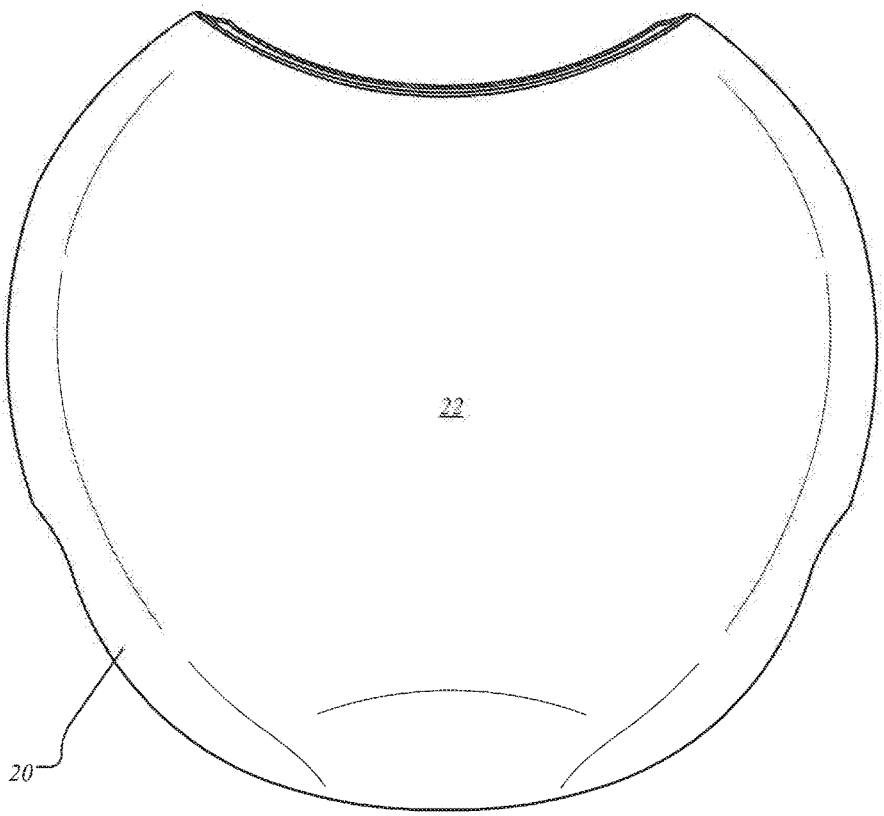
FIG. 8 is an exterior top plan view of the present invention improved safety razor container.

The first eight figures illustrate the present invention improved safety razor container 10 in the closed condition without a safety razorblade cartridge and handle. FIG. 1 is a top-front-right side perspective view of the present invention improved safety razor container 10 without the safety razor cartridge retained therein. FIG. 2 is a top-rear-left side perspective view of the present invention improved safety razor container 10 without the safety razor cartridge retained therein. FIG. 3 is a front view of the present invention improved safety razor container 10 without the safety razor cartridge retained therein. FIG. 4 is a rear view of the present invention improved safety razor container 10 without the safety razor cartridge retained therein. FIG. 5 is a left side view of the present invention improved safety razor container 10 without the safety razor cartridge retained therein. FIG. 6 is a right side view of the present invention improved safety razor container 10 without the safety razor cartridge retained therein. FIG. 7 is a bottom view of the present invention improved safety razor container 10 without the safety razor cartridge retained therein. FIG. 8 is a top view of the present invention improved safety razor container without the safety razor cartridge retained therein.

Referring to FIGS. 1 through 8, the components of the present invention improved safety razor container 10 will be described. The improved safety razor container 10 is a two-part apparatus with a top section and a bottom section retained together by a closing force of a coil spring. The upper or top section 20 includes an exterior top surface 22, an upwardly flared rear end 24 which facilitates grasping the rear end with at least one finger of one hand, such as a thumb. The upwardly flared rear end 24 of the top surface 22 is easy to grasp with a thumb eliminating the need to have a thumb depression and thereby adding to the attractiveness of the outward appearance of the container 10. The upwardly flared rear end 24 also creates a rear opening 26. The top section 20 also includes a front end 28 with an opening 30 which constitutes a top half of a total front opening 70. The top section 20 also has a lower circumferential rim 32.

The improved safety razor container 10 further comprises a mating bottom section 50 having an exterior appearance which is similar to the top section 20. The lower or bottom section 50 includes an exterior bottom surface 52, a downwardly flared rear end 54 which facilitates grasping the bottom rear end with at least one finger of one hand such as a thumb or forefinger. The downwardly flared rear end 54 of the bottom section 50 is easy to grasp with a thumb or forefinger, eliminating the need to have a finger depression and thereby adding to the attractiveness of the outward appearance of the improved safety razor container 10. The downwardly flared rear end 54 also creates a rear opening 56. The bottom section 50 also includes a front end 58 with an opening 60 which constitutes a bottom half of a total front opening 70. The bottom section 50 also has an upper circumferential rim 62 (see FIG. 3).

The flared rear ends 24 and 54 are aligned mirror images of each other with respective rear openings 26 and 56 creating one larger rear opening 80. Referring to FIG. 6, the lower circumferential rim 32 of top section 20 and the upper circumferential rim 62 of bottom section 50 are aligned and touch each other for a distance "D1". The distance "D1" extends from the respective front ends 28 and 58 to a location adjacent the respective rear ends 24 and 54 before they begin to respectively flare upwardly and flare downwardly.

Figure 10:
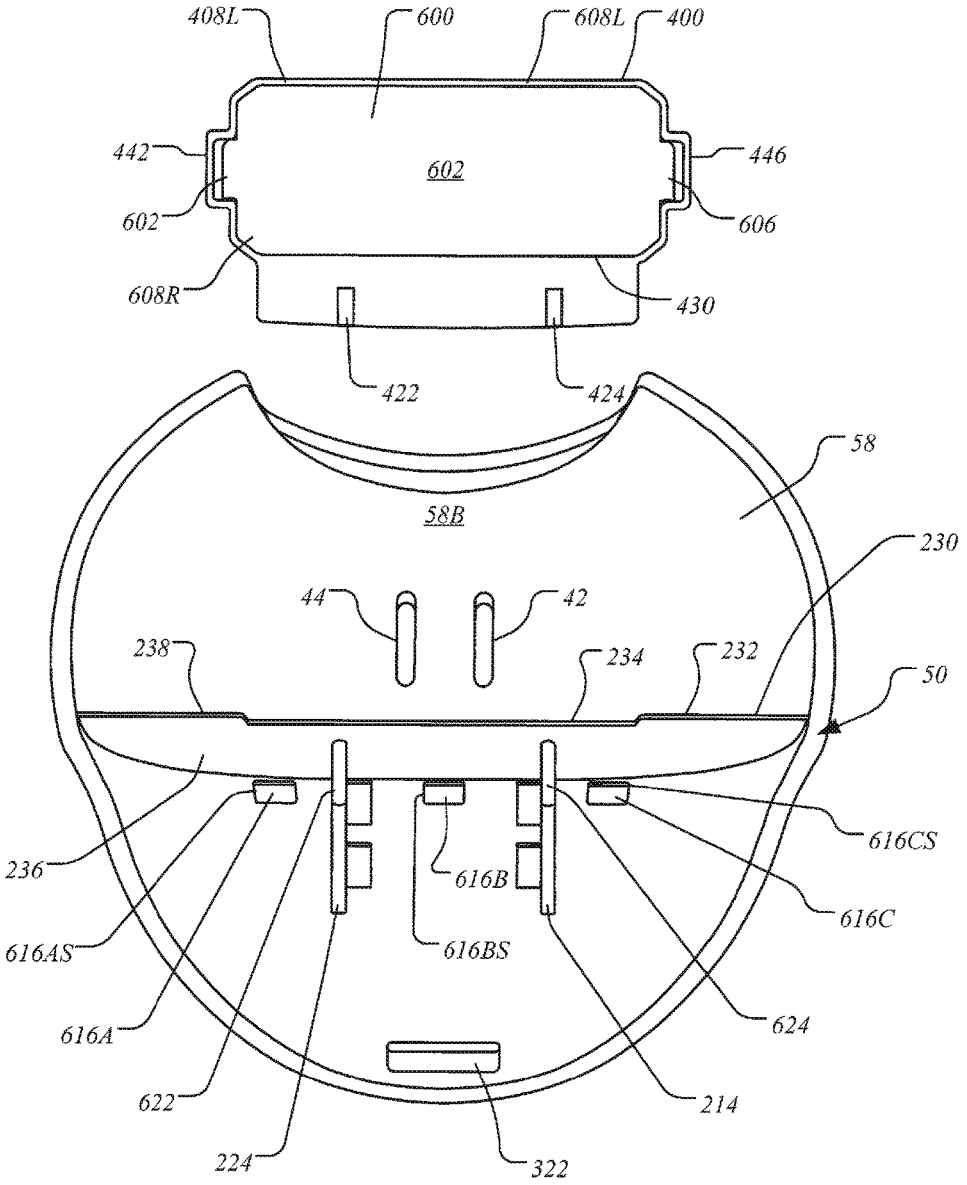
FIG. 10 is an exploded view of the bottom section of the present invention improved safety razor holder with the zinc carrier detached.

As illustrated in FIGS. 7 and 10, the bottom section 50 has a pair of drain holes 42 and 44 which extend from the interior bottom surface 58B to the exterior bottom surface 52 to enable water and excess moisture to drain out of the container 10.

Figure 9:
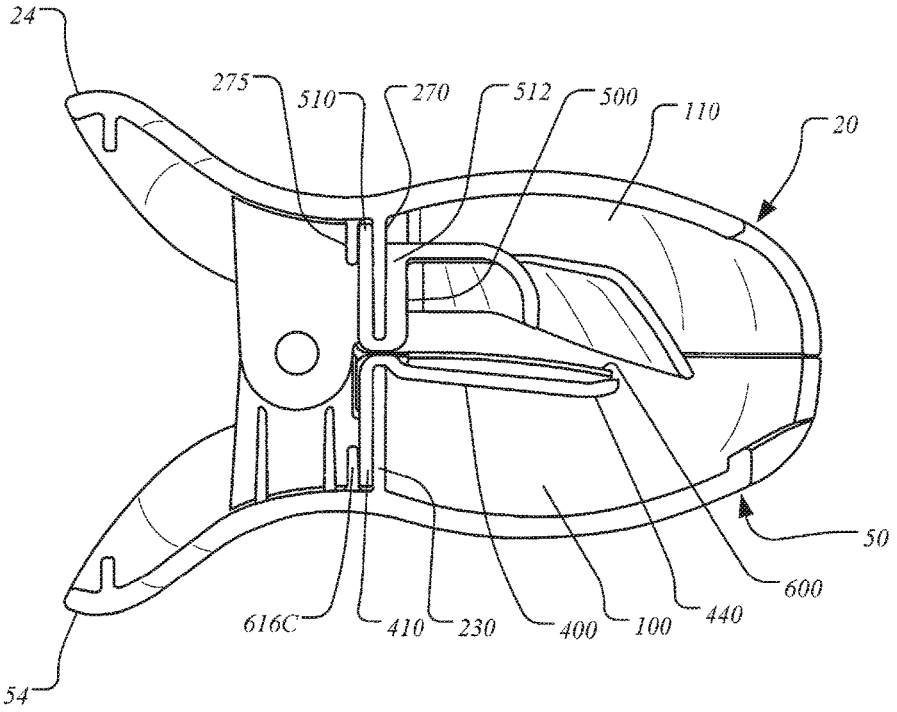
FIG. 9 is a longitudinal cross-sectional view of the present invention improved safety razor holder.

Referring to FIGS. 1, 2 and 9, the top section 20 and bottom section 50 are aligned to surround a lower interior chamber 100 and an upper interior chamber 110. A spring-biased opening and closing assembly 200 includes the follow components.

Figure 9A:
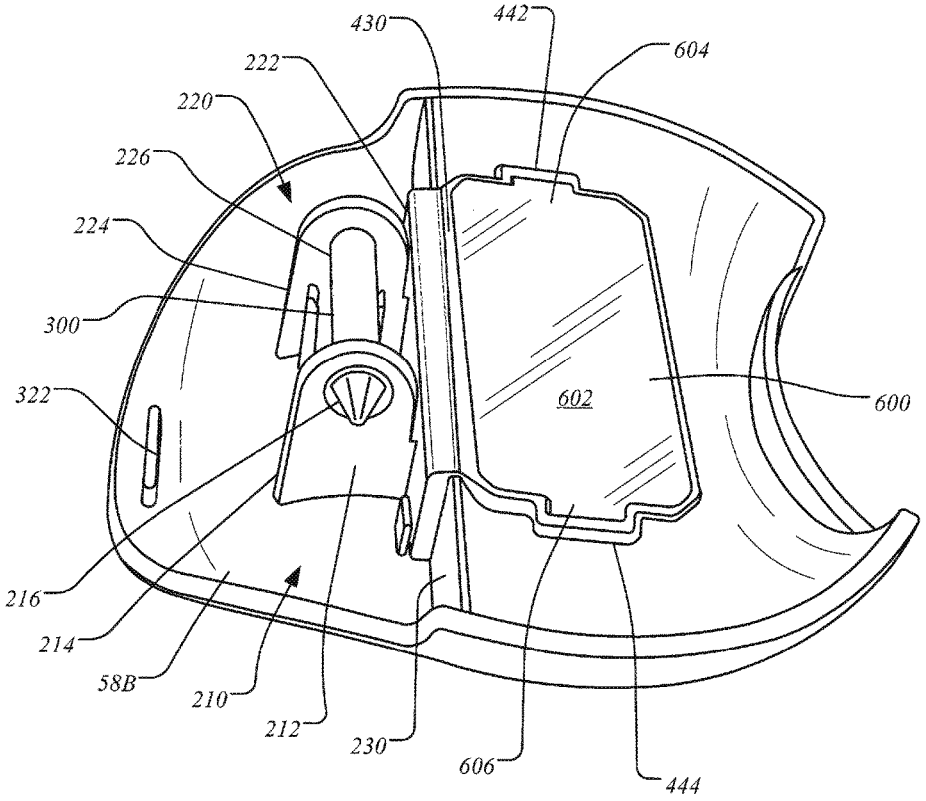
FIG. 9A is a bottom section of the present invention improved safety razor holder with the zinc carrier strip in the attached condition, also illustrating a portion of the upper bosses which retain the closing spring member.

Referring to FIG. 9 there is illustrated a longitudinal cross-sectional view of the present invention improved safety razor holder 10. Referring to FIG. 9A, there is illustrated an interior perspective view of the bottom section 50 with the top section 20 removed. Referring to FIGS. 4 and 9A, the bottom section 50 includes an interior bottom surface 58B with a first retaining boss 210 having a first leg 212 affixed to the interior bottom surface 58B and affixed to a lower interior transverse wall 230, the first retaining boss 210 having a rear post 214 having a first opening 216. The opening and closing assembly 200 further includes a second retaining boss 220 having a second leg 222 affixed to the interior bottom surface 58B and to the lower interior transverse wall 230, the second retaining boss 220 having a rear post 224 having a second opening 226. Referring to FIGS. 4 and 9A, the first retaining boss 210 and second retaining boss 220 are parallel to each other and spaced apart by a distance "D2". Respective openings 216 and 226 are aligned with each other.

Figure 11:
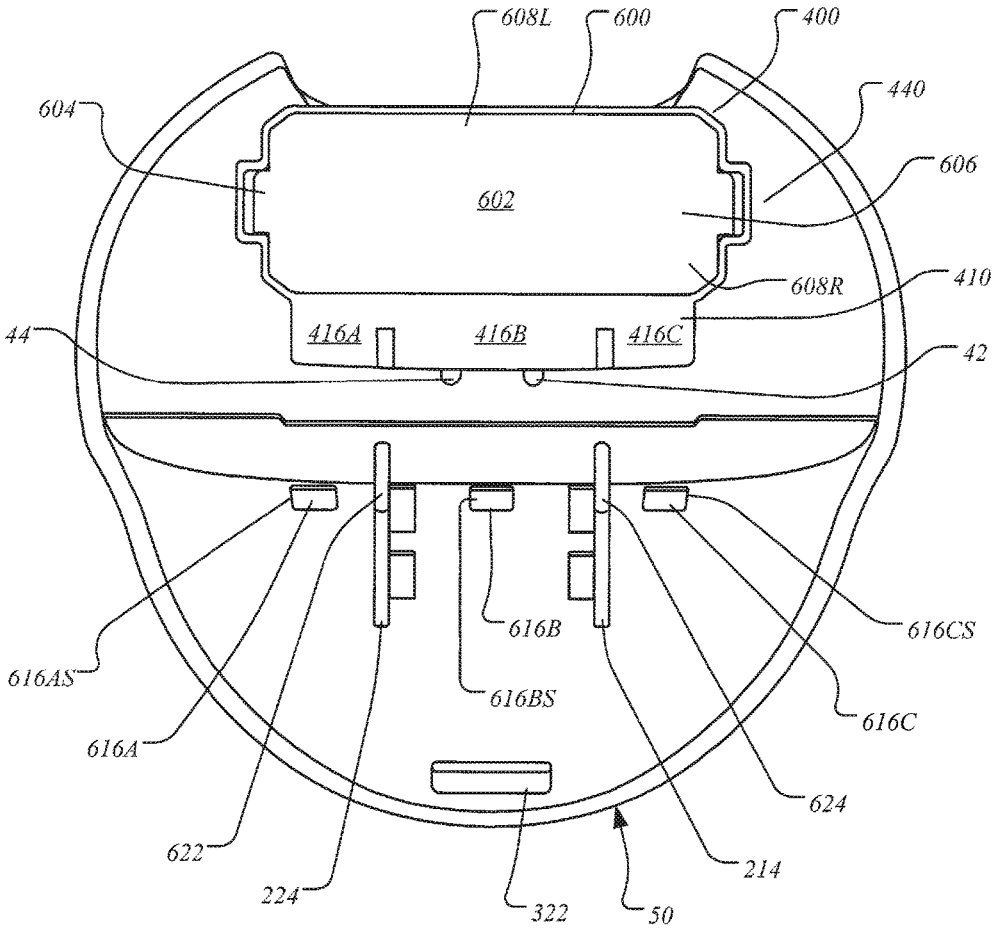
FIG. 11 is a bottom view of the present invention improved safety razor holder with zinc carrier detached.
Figure 12:
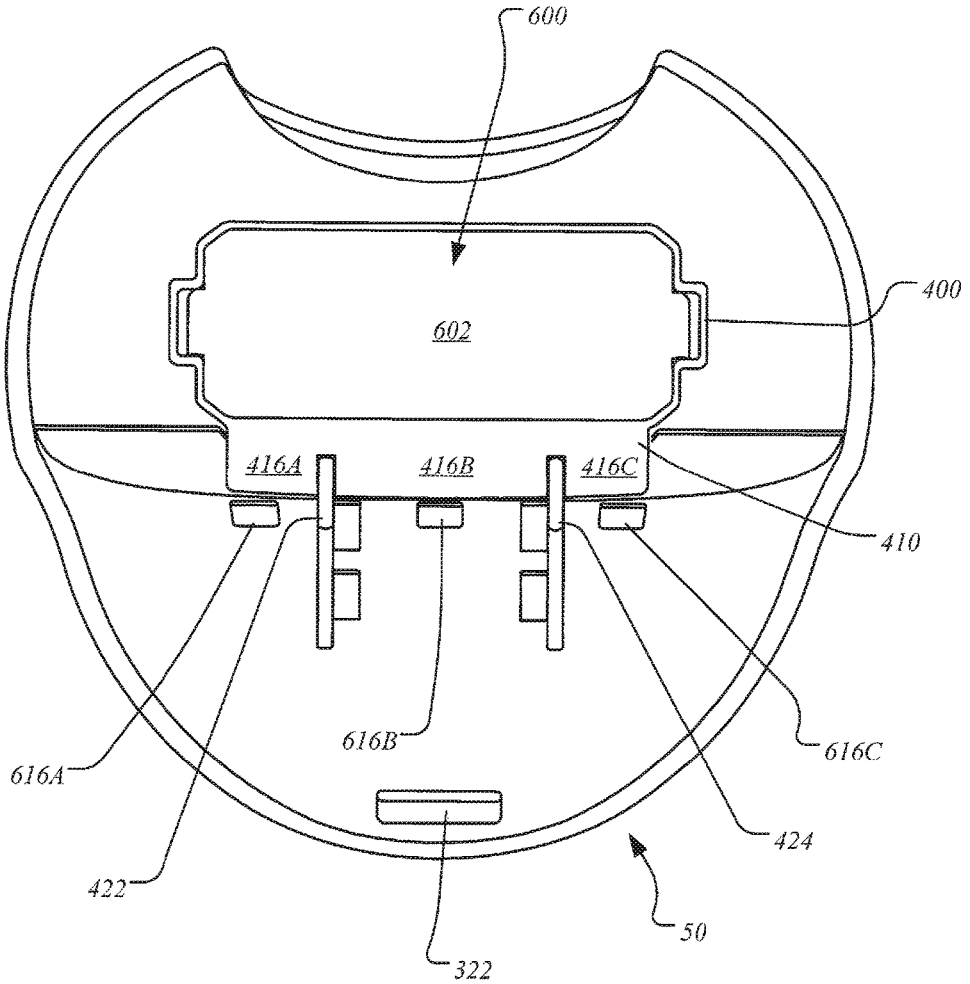
FIG. 12 is a bottom view of the bottom section of the present invention improved safety razor holder with the zinc carrier press fit retained into the bottom section.

One unique innovation and improvement over the prior art patents created by the same inventors is a significant improvement in the retention of a zinc metal strip. As described in U.S. Pat. No. 9,380,850, a safety razor from a razor blade cartridge is forced into contact with or adjacent to the zinc metal strip which reduces oxidation, corrosion and other chemical reactions with the razor blade. The significant improvement in the retention of the zinc metal strip is illustrated in FIGS. 9A, 11 and 12. Referring to these figures, there is illustrated the bottom section 50. The zinc metal strip ("zinc strip") is retained in a convex bowed manner by a zinc strip carrier ("zinc carrier") 400. This combination is illustrated in a fixed and in use condition in FIG. 9A; is illustrated in an exploded condition in FIG. 10; is illustrated in a detached condition in FIG. 11; and is illustrated in an attached condition when viewed from the rear in FIG. 12.

The vertical wall 410 of zinc carrier strip 400 is press fit retained between the rear surface 236 of lower interior transverse wall 230 and retaining members as described below. The rear horizontal edge of the zinc carrier strip 400 is placed onto interior lower transverse wall 230 adjacent to recessed center ledge 234. The zinc carrier 400 has a vertical wall 410 that is comprised of three sections, carrier left section 416A, carrier middle section 416B, and carrier right section 416C. A first zinc carrier groove 422 is between carrier left section 416A and carrier middle section 416B. A second zinc carrier groove 424 is between carrier middle section 416B and carrier right section 416C. Lower interior transverse wall 230 is fixed in bottom surface 58B and to interior sidewall 58 of lower section 50. Lower interior transverse wall 230 has as upper ledge 232 with a center recessed section 234. Lower interior transverse wall 230 has a rear surface 236 and a front surface 238. The first leg 212 is affixed to lower interior carrier wall rear surface 236 and a spaced apart second leg 224 is affixed to lower interior carrier wall rear surface 236. First zinc carrier groove 422 is aligned with first leg 612 and second zinc carrier groove 424 is aligned with second leg 622. Also affixed to bottom surface 58B at a spaced apart distance from rear surface 236 is first zinc carrier retaining wall 616A with a gap 616AS between the rear surface 236 and first zinc carrier retaining wall 616A. At a spaced apart transverse distance, also affixed to bottom surface 58B at a spaced apart distance from rear surface 236 is second zinc carrier retaining wall 616B with a gap 616BS between the rear surface 236 and the second zinc carrier retaining wall 616B. At a spaced apart transverse distance, also affixed to bottom surface 58B at a spaced apart distance from rear surface 236 is third zinc carrier retaining wall 616C with a gap 616CS between the rear surface 236 and the third zinc carrier retaining wall 616C.

The zinc carrier 400 in the in use condition is removably press fit retained onto lower interior transverse wall 230 by first zinc carrier groove 422 press fit onto first leg 622 and second zinc carrier groove 424 press fit onto second leg 626. The lower end walls are respectively retained between a respective zinc carrier retaining wall 616A, 616B and 616C and rear surface 236. Lower end wall 416A is press fit retained within gap 616AS, lower end wall 416B is press fit retained within gap 616BS and lower end wall 416C is press fit retained within gap 616CS.

As illustrated in FIG. 10, there are two drain holes 44 and 42 to allow the present invention improved safety razor holder a means to drain excess water and to reduce mold and bacteria from developing within the container.

Referring to FIGS. 9, 9A and 11, there is illustrated zinc carrier 400 having a zinc carrier vertical wall 410 that transitions from a vertical surface to zinc carrier horizontal wall 430 which has a circumferential edge 440 with a front edge 408L, a rear edge 408R, a left ear 442 and a right ear 446. Zinc carrier horizontal wall 440 provides the platform on which zinc strip 600 rests.

Referring to FIGS. 9, 9A and 12, there is illustrated the fully inserted zinc carrier 400 press fit retained onto interior lower transverse wall 230 as described above. The zinc strip 600 is retained onto zinc carrier 400 so that zinc strip 600 is bowed upward in a convex shape away from interior surface 58B. Zinc strip 600 has an uppermost center location 602, a left tab 604 pressed against left ear 442 and a right tab 606 pressed against right ear 446. Front edge 608L is press fit retained against zinc carrier strip front border. 408L. The zinc carrier strip 600 also has a rear edge 608R. As best illustrated in FIG. 9, the zinc strip 600 is bowed convex away from horizontal wall 430 of zinc carrier strip 400.

Therefore, zinc strip 600 is bowed upwardly in a convex shape relative to zinc carrier horizontal wall 430. Therefore, zinc strip 600 has a zinc strip center 602 that is slightly higher than each of the ends 604 and 606.

An optional innovation over the present inventors' prior invention is: (i) the zinc strip 600 is removably retained within container 10 so it can be replaced with a new fresh zinc strip; (ii) the zinc strip 600 is bowed upward to bring the shaver blade into closer contact with the zinc strip 600.

Figure 13:
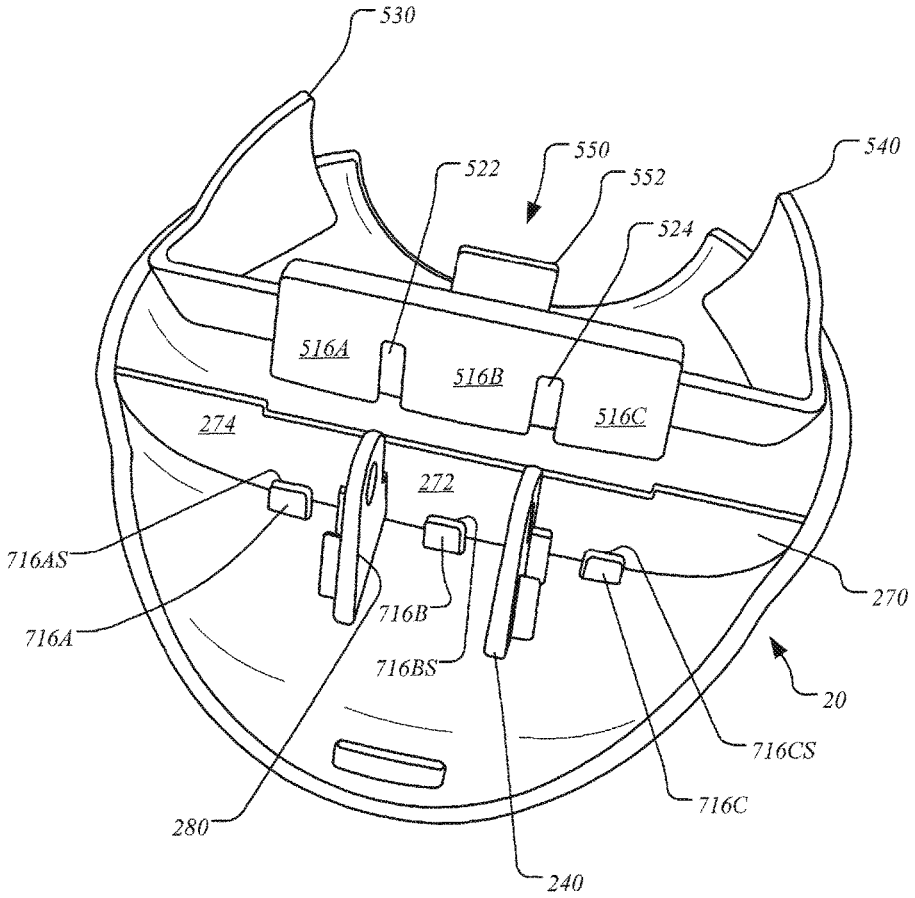
FIG. 13 is a view from the top section of the present invention safety razor holder with the central stabilizer wings detached.

Referring to FIGS. 13, 14, 15 and 16, there is illustrated a bottom perspective views of the top section 20. Referring to FIGS. 4 and 13, the spring biasing closing assembly includes the following additional components. The top section 20 includes an interior top surface 34 with a third retaining boss 240 having a third leg 242 affixed to the interior top surface 34 and affixed to an upper interior transverse wall 270. The third retaining boss 240 has a rear post 264 having a third opening 266. The opening and closing assembly 200 further includes a fourth retaining boss 280 having a fourth leg 282 affixed to the interior top surface 34 and an upper interior transverse wall 270, the fourth retaining boss 280 having a rear post 284 having a fourth opening 286. The respective retaining post 264 of the third retaining boss 240 and the respective retaining post 284 of fourth retaining boss 280 are parallel to each other and spaced apart by a distance "D3" (see FIG. 4). Respective openings 266 and 286 are aligned with each other.

Distance "D3" is smaller than distance "D2" so the openings are aligned in the following order: 216, 286, 266 and 226. A dowel, retaining bolt or comparable transverse member 300 extends through the four openings 216, 286, 266 and 226 respectively located in four posts 214, 284, 264, and 224. A closing force member such as coil spring 310 is wound around dowel 300 and has spring ends, of which a first spring end 320 rests against the lower blocking member 322 affixed to interior surface 58B of bottom section 50 adjacent rear end 54 and a second spring end 330 rests against blocking member 332 affixed to upper interior surface 34 of top section 20 and adjacent rear end 34.

The closing force member or closing spring force 310 forces the top section 20 and bottom section 50 of the container 10 together so that the container is in the closed position. A squeezing force on the upwardly flared rear end 24 and downwardly flared rear end 54 overcomes the bias spring closing force and forces the top section 20 away from the bottom section 50 with the dowel 300 acting as the fulcrum about which the top section 20 and bottom section 50 rotate.

As previously discussed, the zinc carrier strip 400 retaining the zinc strip 600 is retained within the container 10. In an alternative retaining variation for the zinc carrier 400, referring to FIG. 9, there is illustrated the zinc carrier 400 and a central tab with wings 500. Zinc carrier 400 has a zinc carrier vertical wall 410 that fits in between lower interior It is also within the spirit and scope of the present invention transverse wall 230 and respective gaps between respective zinc carrier retaining walls, with only zinc carrier retaining walls 616C illustrated in FIG. 9 to retain zinc carrier 400 to bottom section 50. It is also an option for the zinc carrier 400 to be press fit retained within the container 10 and also to be removably press fit retained within the container 10. Similarly, central tab with wings 500 has a central tab vertical wall 510 that fits in between upper interior transverse wall 270 to retain central stabilizer with wings 500 to top section 20. It is also within the spirit and scope of the present invention for the central stabilizer with wings 500 to be press fit retained to the top section 20.

Figure 15:
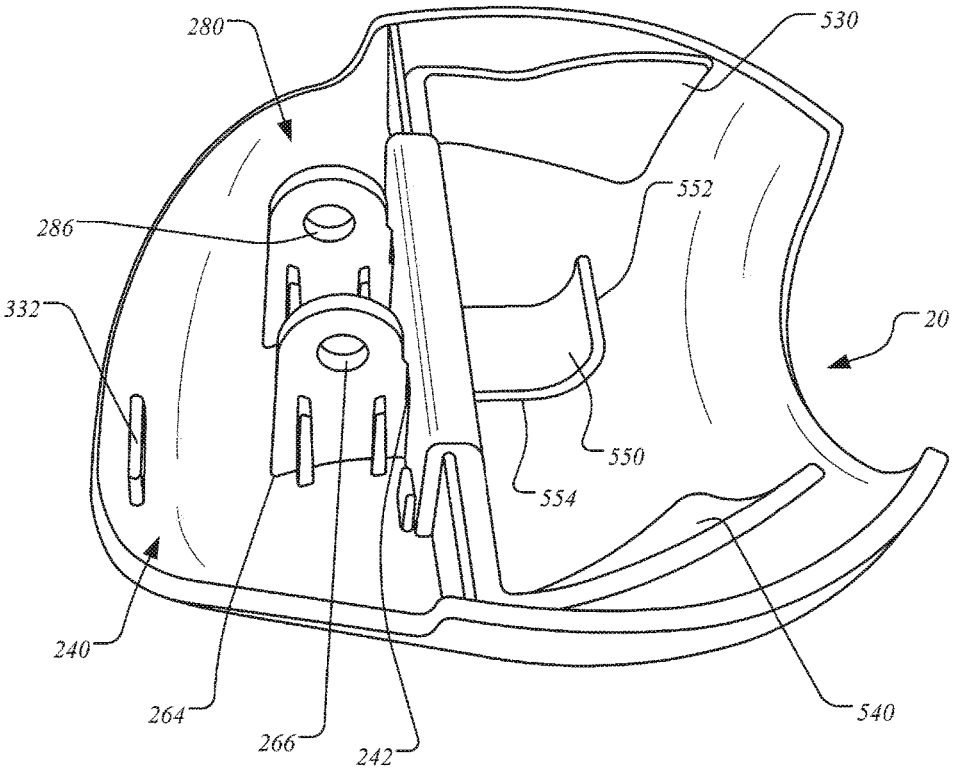
FIG. 15 is a view of the top section of the present invention improved safety razor holder shown inverted with the central stabilizer with wings press fit retained to the top section.
Figure 16:
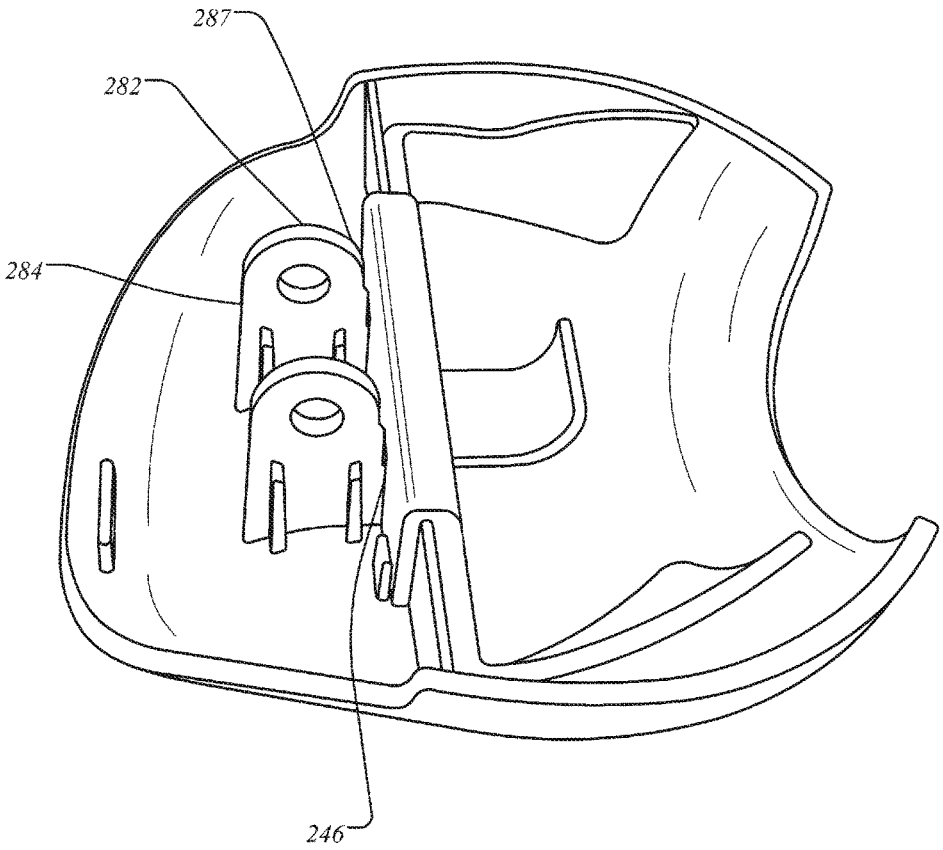
FIG. 16 is another view of the top section of the present invention improved safety razor holder shown inverted with the central stabilizer with wings press fit retained to the top section.

Referring to 13 there is illustrated a bottom rear perspective view of the top section 20 of the container 10. The top section 20 includes an interior top surface 34 with the third retaining boss 240 having a third leg 242 affixed to the interior top surface 34 and upper interior transverse wall 270. The third retaining boss 240 having a rear post 264 having a third opening 266. Referring to FIGS. 15 and 16, a first upper gap 246 is formed over the third leg 242 between the interior surface 276 of upper interior transverse wall 270 and rear post 264. The opening and closing assembly 200 further includes a fourth retaining boss 280 having a fourth leg 282 affixed to the interior top surface 34 and upper interior transverse wall 270, the fourth retaining boss 280 having a rear post 284 having a fourth opening 286. A first upper gap 246 is formed over the third leg 242 between the interior surface 276 of upper interior transverse wall 270 and rear post 248. A second upper gap 287 is formed over the fourth leg 282 between the interior surface 276 of upper interior transverse wall 270 and rear post 288.

Figure 14:
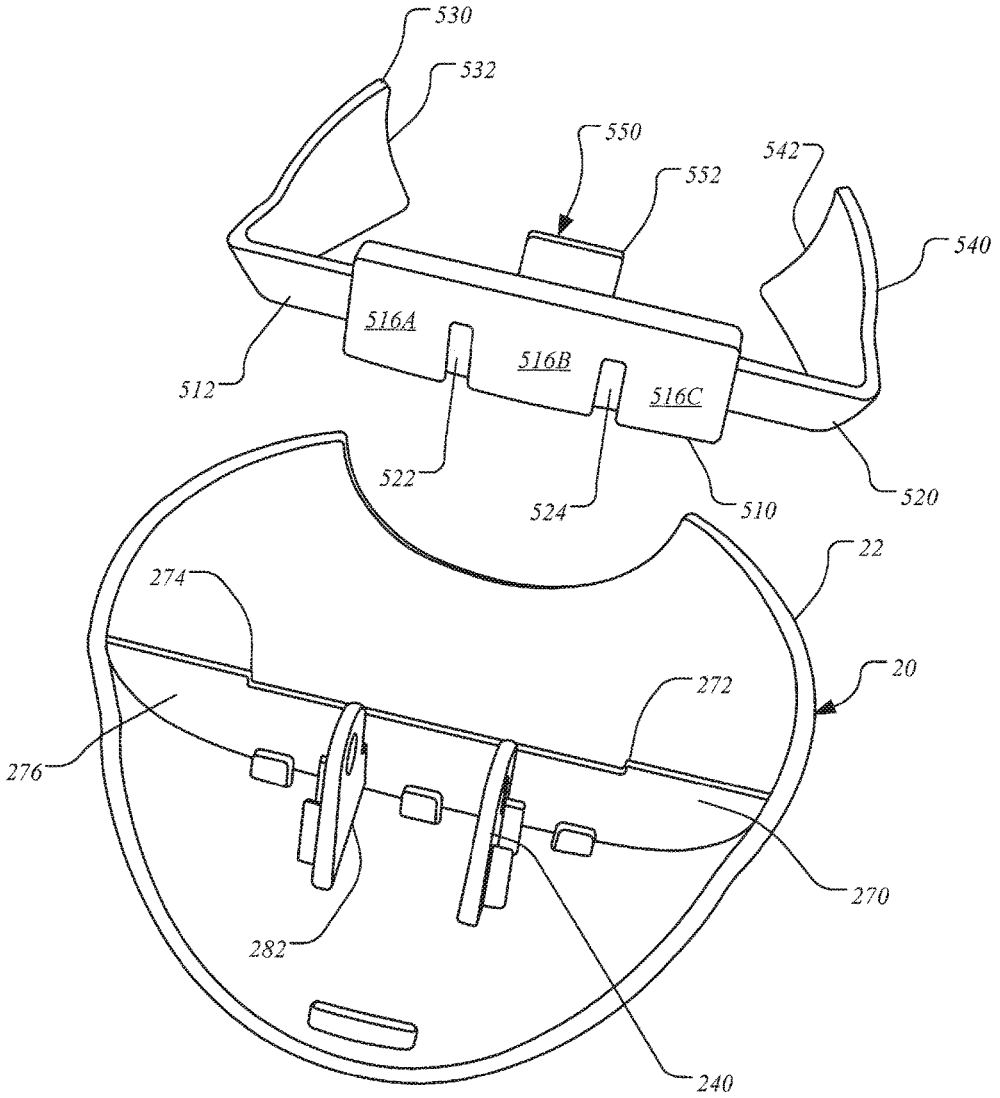
FIG. 14 is an exploded view of the top section of the present invention improved safety razor holder shown inverted with the central stabilizer with wings detached.
Figure 19:
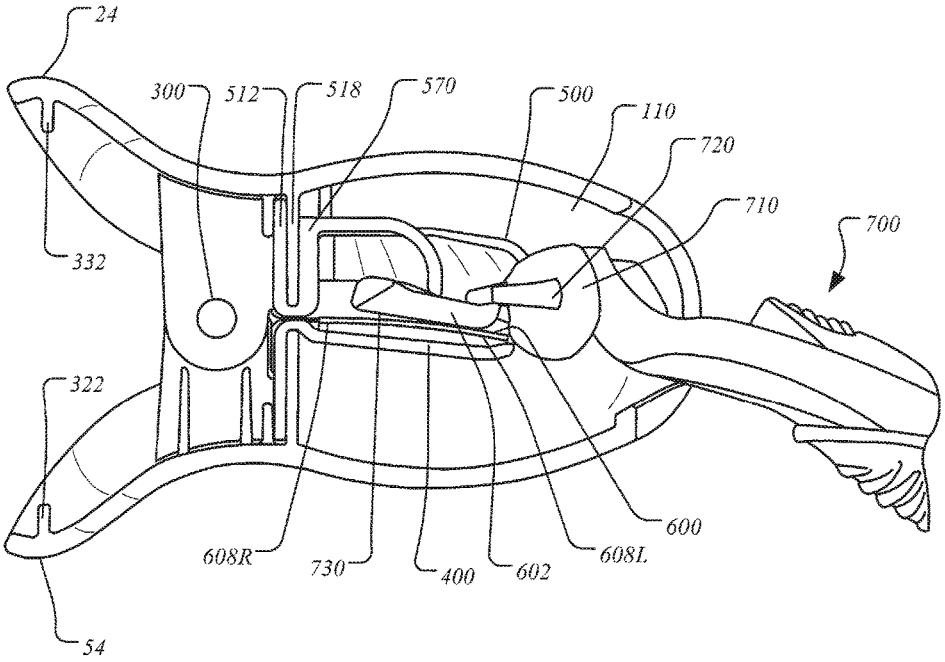
FIG. 19 is a longitudinal cross-sectional view of the present invention improved safety razor holder with the safety razorblade retained therein.

Another key innovation over the previous invention disclosed in U.S. Pat. No. 9,581,341 by the same two inventors is an improved spring mechanism to provide a downward force on the razor blade cartridge to force a razor blade onto or adjacent to the zinc strip 600. Referring to FIG. 14, there is illustrated top section 20 portion of the present invention improved safety razor container 10 inverted and resting on exterior top surface 22. Adjacent and illustrated above and removed from top section 20 is the key innovation central stabilizer with wings 500. The central upper interior wing wall 520 extends to a central first wing or left (direction based on during use) wing 530 and a second wing or right wing 540. As best illustrated in FIG. 16, also incorporated as part of the central stabilizer with wings is a first or front wall 510 and a second or rear wall 512 separated by a groove 518. Central upper interior transverse wall 270 has a lower ledge 272 with a recessed area 274. The first wall 510 and the second wall 512 are inserted over central upper interior wall 270 so that the groove 518 aligns with the ledge recessed area 274. The central interior wing wall 520 is incorporated into first wall 510 and rests against a front surface 279 of central upper interior transverse wall 270 (see FIG. 16). A longitudinal wall 554 is transversely incorporated into a front surface 513 of front wall 510 and extends toward opening 200 but curves downwardly with a distal arcuate section 556 terminating in a tab 550 with a bottom surface extending in the direction of zinc strip 600 and a central tab 550 that assists in retaining a multitude of different shaped razor blade cartridges. Central tab 550 rests on top of a razor blade cartridge 710 as shown in FIG. 19.

Central tab 550, first wing 530, and second wing 540 create a large surface area by which a downward force over that area is exerted when the improved safety razor container 10 is in the closed condition to better retain both smaller and larger razor blades. Central tab 550 has a central tab bottom surface 552, first wing 530 has a bottom first wing surface 532, and second wing 540 has a bottom second wing surface 542. Central tab bottom surface 552, bottom first wing surface 532, and bottom second wing surface 542 form the contacts by which central stabilizer with wings 500 provides a downward force over an increased surface area to better retain large and small razorblade cartridges.

Referring to FIGS. 13, 14, 15 and 16, for attachment to top section 20, central stabilizer with wings 500 has two vertical walls 510 and 512 that meet together to form a U-shaped groove 518 that upper interior transverse wall 270 and central upper wing wall 520 fits between. Central stabilizer second wall 512 has three distinct sections, stabilizer left section 516A, stabilizer middle section 516B, and stabilizer right section 516C. A first U-shaped groove 522 is between stabilizer left section 516A and stabilizer middle section 516B. A second U-shaped groove 524 is between stabilizer middle section 516B and stabilizer right section 516C. First U-shaped groove 522 is aligned with gap 287 and rests on fourth leg 282. Second U-shaped groove 524 is aligned with gap 246 and rests on third leg 242.

Referring to FIG. 13, affixed to upper interior surface 34 is a first wing retaining wall 716A with a gap 716AS between the rear surface 276 of upper interior transverse wall 270 and the first wing retaining wall 716A. At a spaced apart transverse distance, also affixed to upper interior surface 34 is a second wing retaining wall 716B with a gap 716BS between the rear surface 276 of upper interior transverse wall 270 and the second wing retaining wall 716BS. At another spaced apart transverse, affixed to upper interior surface 34 is a third wing retaining wall 716C with a gap 716CS between the rear surface 276 of upper interior transverse wall 270 and the first wing retaining wall 716CS.

The central stabilizer with wings 500 are press fit affixed as follows. The interior top transverse wall 270 is press fit retained in groove 518 between interior upper wing wall 520, front wall 510 and rear wall 512. In stabilizer wall, left section 516A is press fit retained in gap 716AS between first wing retaining wall 716A and rear surface 276 of upper interior transverse wall 270. In stabilizer wall, middle section 516B is press fit retained in gap 716BS between second wing retaining wall 716B and rear surface 276 of upper interior transverse wall 270. In stabilizer wall, right section 516C is press fit retained in gap 716CS between Third wing retaining wall 716C and rear surface 276 of upper interior transverse wall 270. First U-shaped groove 522 is press fit retained in gap 287 and rests on leg 282. Second U-shaped groove 524 is press fit retained in gap 246 and rests on leg 286. It is also within the spirit and scope of the present invention for the central stabilizer with wings 500 to be removably affixed as set forth in this paragraph and also to be press fit affixed as set forth in this paragraph and a combination of both removably press fit affixed to the interior top of the container as discussed in this paragraph.

Figure 17:
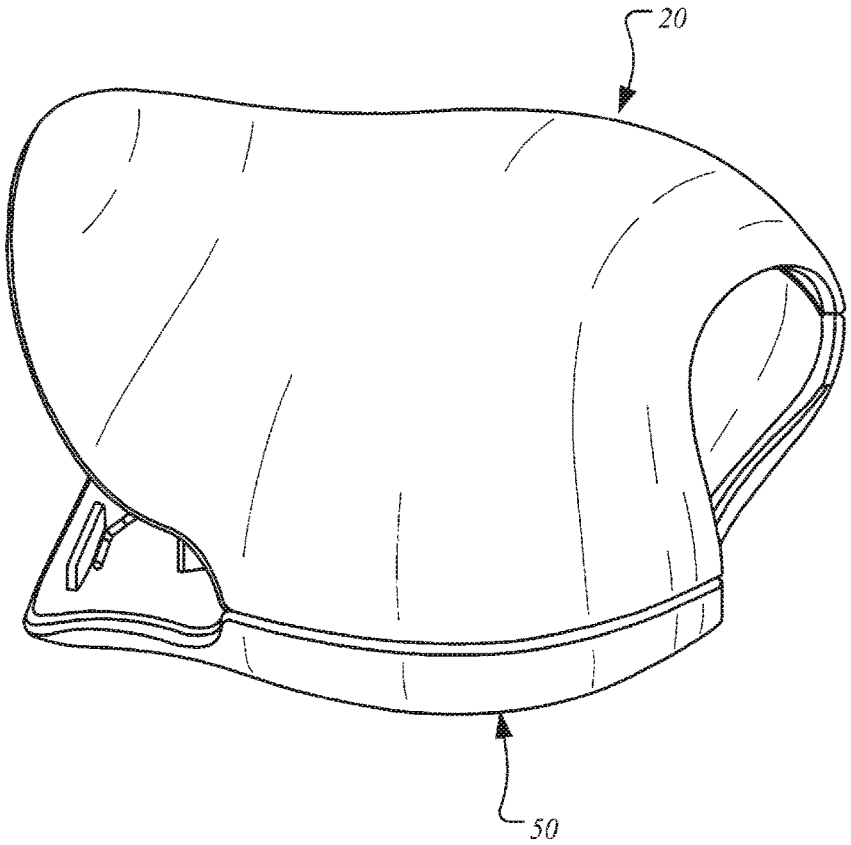
FIG. 17 is a top-side view of the improved safety razor holder in the closed condition without a safety razorblade retained within.
Figure 18:
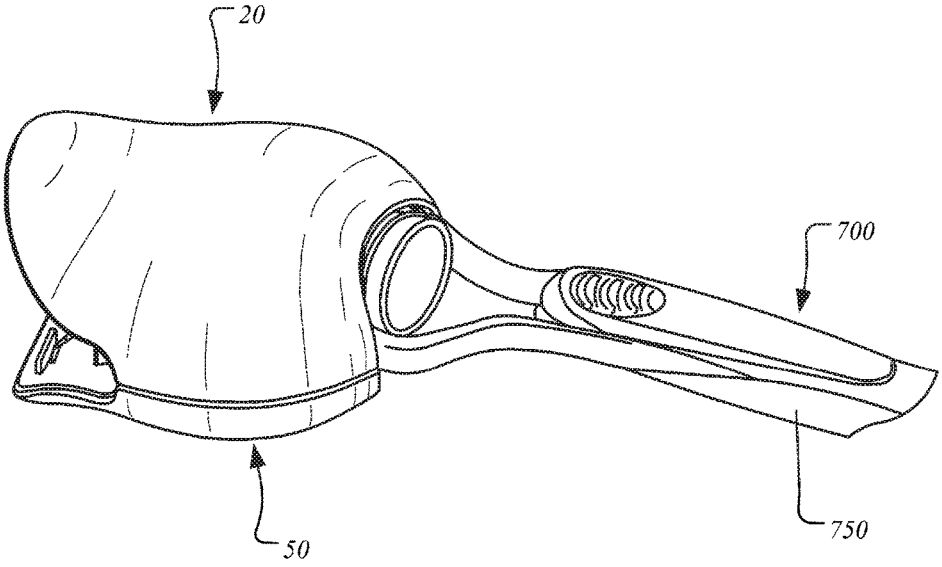
FIG. 18 is a top-side view of the improved safety razor holder in the closed condition with a safety razorblade retained within.

FIG. 17 illustrates is a top-side view of the improved safety razor holder in the closed condition without a safety razorblade retained within and FIG. 18 illustrates a top-side view of the improved safety razor holder in the closed condition with a safety razorblade retained within. Referring to FIGS. 17 and 18, there is the top section 20 closed over the bottom section 50 with a safety razor 700 being retained in FIG. 12 and having the handle 750 of the safety razor extending out.

Referring to FIG. 19, there is illustrated a longitudinal cross-sectional view of the present invention improved safety razor holder 10. Also illustrated is a safety razor 700 that has been inserted into the interior chamber 100, so that a razorblade cartridge 710 rests partially with lower interior chamber 100 and partially within upper interior chamber 110. A razorblade 720 within the razorblade cartridge 710 faces into the interior chamber 100 so that the tips 730 of the razorblades 720 either touch the zinc strip 600 or are adjacent to the zinc strip 600 toward the interior surface 54 of bottom section 50. Therefore, the closing force of the biasing spring forces the sharp edge of at least one razorblade against the strip of metal made of zinc 600.

The improved safety razor holder 10 retains the tips 730 of the razorblades 720 in the razorblade cartridge 710 (illustrated in FIG. 19) against or in close proximity to a zinc strip 600, to significantly reduce oxidation, corrosion and other chemical reactions which deteriorate the razorblades 720.

The improved safety razor holder 10 is opened by a force to overcome the spring biasing closing force as previously described and when the improved safety razor holder 10 is in the opened condition, the safety razor 700 can be quickly removed and is ready for immediate use. The zinc strip 600 assures that the razorblades 720 will remain free of germs. The improved safety razor holder 10 can be made out of material selected from the group consisting of plastic polypropylene and metal.

The improved safety razor holder 10 retains the tips 730 of the razorblades 720 in the razorblade cartridge 710 (illustrated in FIG. 19) against or in close proximity to a zinc strip 600, to significantly reduce oxidation, corrosion and other chemical reactions which deteriorate the razorblades 720.

Figure 20:
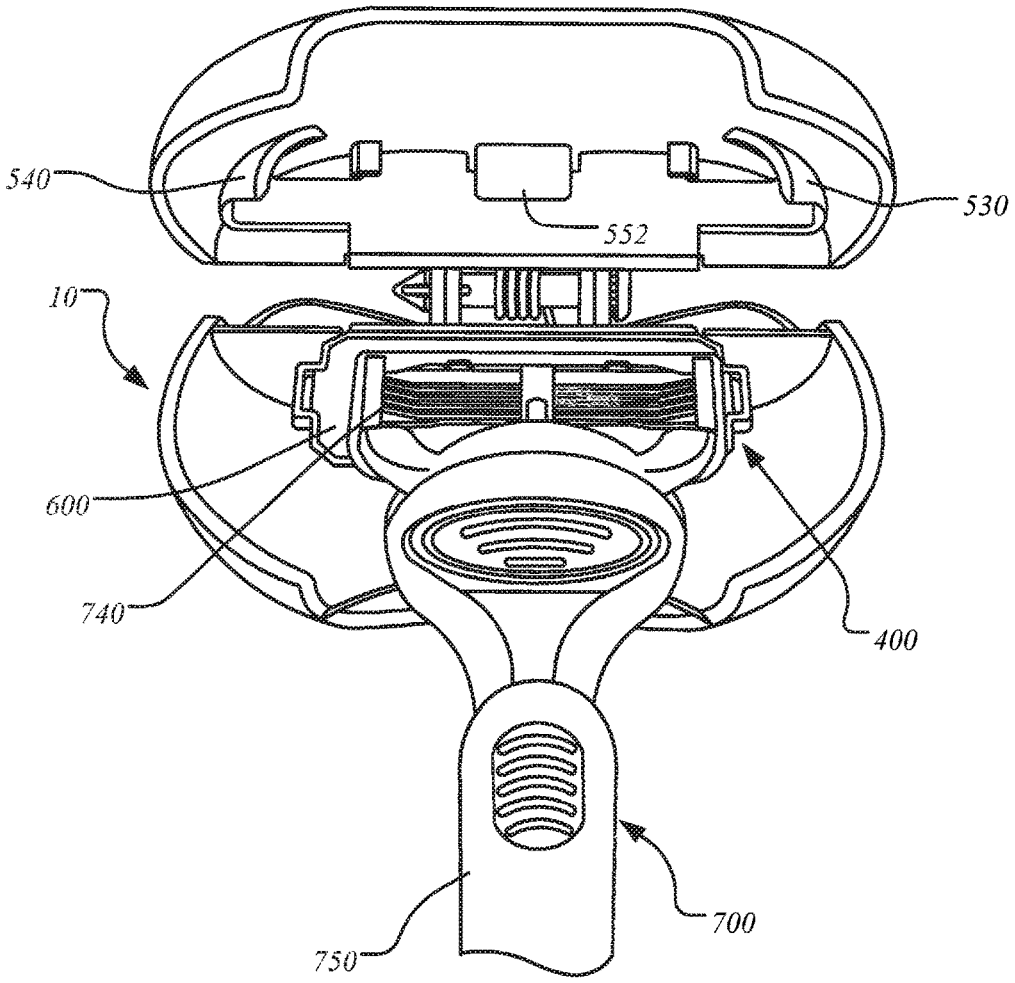
FIG. 20 is a top perspective view of the present invention improved safety razor holder in the open condition with the razorblade retained therein.

Referring to FIG. 20, there is illustrated a top perspective view of the improved safety razor holder 10 in the open condition illustrating a safety razor 700 positioned with the blade of safety razor 700 resting on zinc carrier 400 prior to closing.

The improved safety razor holder 10 is opened by a force to overcome the spring biasing closing force as previously described and when the improved safety razor holder 10 is in the opened condition, the safety razor 700 can be quickly removed and is ready for immediate use. The zinc strip 600 assures that the razorblades 720 will remain free of germs. The improved safety razor holder 10 (also referred to as container 10) can be made out of material selected from the group consisting of plastic polypropylene and metal.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A container adapted for use with a safety razor having a razorblade cartridge containing at least one razorblade having a sharp front edge, with the container having a top section and a mating bottom section with an interior chamber, the container comprising;

a. the mating bottom section includes an interior bottom surface with a first retaining boss having a first leg affixed to the interior bottom surface and affixed to a lower interior transverse wall, the first retaining boss having a rear post having a first opening, a second retaining boss having a second leg affixed to the interior bottom surface and to the lower interior transverse wall, the second retaining boss having a rear post having a second opening which is aligned with the first opening, the first retaining boss and second retaining boss are parallel to each other and spaced apart by a first distance;

b. a zinc strip retained in a convex bowed manner by a zinc carrier, the zinc carrier having a vertical wall including a carrier left section, a carrier middle section, and a carrier right section, a first zinc carrier groove between the carrier left section and the carrier middle section and a second zinc carrier groove between the carrier middle section and the carrier right section;

c. said lower interior transverse wall fixed to the interior bottom surface and to an interior sidewall of the bottom section of the container, the lower interior transverse wall having an upper ledge with a center recessed section, the lower interior transverse wall having a rear surface and a front surface, a first carrier notch is affixed to a lower interior carrier wall rear surface and a spaced apart second carrier notch is affixed to lower interior carrier wall rear surface, the first zinc carrier groove aligned with first carrier notch and the second zinc carrier groove aligned with the second carrier notch, also affixed to said bottom surface at a spaced apart distance from the rear surface of the lower interior transverse wall is a first zinc carrier retaining wall with a gap between the rear surface of the lower interior transverse wall and the first zinc carrier retaining wall, at a spaced apart transverse distance, also affixed to said bottom surface at a spaced apart distance from rear surface of the lower interior transverse wall is a second zinc carrier retaining wall with a gap between the rear surface of the lower interior transverse wall and the second zinc carrier retaining wall, and at a spaced apart transverse distance, also affixed to said bottom surface at a spaced apart distance from the rear surface of the lower interior transverse wall is a third zinc carrier retaining wall with a gap between the rear surface of the lower interior transverse wall and the third zinc carrier retaining wall;

d. the zinc carrier press fit retained onto the lower interior transverse wall by the first zinc carrier groove press fit onto the first zinc carrier notch and the second zinc carrier groove press fit onto the second zinc carrier notch, the carrier left section press fit retained in the gap between the first zinc carrier retaining wall and the rear surface of the lower interior transverse wall, the carrier middle section press fit retained in the gap between the second zinc carrier retaining wall and the rear surface of the lower interior transverse wall, and the carrier right section press fit retained in the gap between the third zinc carrier retaining wall and the rear surface of the lower interior transverse wall;

e. the zinc carrier vertical wall transitions to a zinc carrier horizontal wall which has a circumferential edge with a front edge, a left ear and a right ear, the zinc strip press fit retained onto the first zinc carrier horizontal wall with a left tab of the zinc strip press fit retained against said left ear, a right tab of the zinc strip press fit retained against said right ear, and a front edge of the zinc strip press fit retained against said front edge, with the zinc strip is bowed upward in a convex shape relative to the zinc carrier horizontal wall and away from said lower interior surface so that the zinc strip has an uppermost center location;

f. the top section of the container includes an upper interior transverse wall affixed to an upper interior surface and oppositely disposed upper interior sidewalls, a third retaining boss having a third leg affixed to the interior top surface and affixed to the upper interior transverse wall, a fourth retaining boss having a fourth leg affixed to the interior top surface and affixed to the upper interior transverse wall;

g. a central stabilizer including a central upper interior wing wall extending to a first wing extending to a left upper interior sidewall, the central upper interior wing wall extending to an oppositely disposed second wing extending to a right upper interior sidewall, also incorporated as part of the central stabilizer is a vertical front wall and a vertical rear wall separated by a U-shaped groove, the upper interior transverse wall having a lower ledge with a recessed area, the vertical front wall, the central upper interior wing wall and the vertical rear wall inserted over the central upper interior wall so that the groove aligns with the ledge recessed area, the central interior wing wall is incorporated into the first wall and rests against a front surface of central upper interior transverse wall, a longitudinal wall is incorporated into a front surface of the front wall and extends perpendicularly to the front wall and toward upper section front opening but curves downwardly with a distal arcuate section terminating in a tab with a bottom surface aligned with and extending in the direction of the zinc strip;

h. the vertical rear wall of the central stabilizer having three distinct sections, stabilizer left section, stabilizer middle section and stabilizer right section, affixed to the upper interior surface is a first wing retaining wall with a first gap between the rear surface of upper interior transverse wall and the first wing retaining wall with the stabilizer left section press fit retained within the first gap, at a spaced apart transverse distance, also affixed to the upper interior surface is a second wing retaining wall with a second gap between the rear surface of upper interior transverse wall and the second wing retaining wall with the stabilizer center section press fit retained within the second gap, and at a spaced apart transverse distance, also affixed to the upper interior surface is a third wing retaining wall with a third gap between the rear surface of upper interior transverse wall and the third wing retaining wall with the stabilizer center section press fit retained within the third gap, a first U-shaped groove is between stabilizer left section and stabilizer middle section, a second U-shaped groove is between stabilizer middle section and stabilizer right section, the first U-shaped groove is aligned with and rests on said third leg, the second U-shaped groove is aligned with and rests on said fourth leg;

i. a pole extending through said respective openings in said first boss, second boss, third boss and fourth boss, the pole joining the upper section to the lower section, a coil spring wrapped around the pole with a first end of the coil spring in contact with the lower interior surface and a second end of the coil spring in contact with the upper interior surface, the coil spring creating a closing force to close the upper section onto the lower section with a front opening when the upper section and lower section are closed; and j. the orientation of the zinc strip causing the zinc strip to extend towards the upper interior surface, the center tab creating a downward force in the direction of the lower section and the central stabilizer including the central upper interior wing wall extending to the first wing extending to a left upper interior sidewall and the central upper interior wing wall extending to the oppositely disposed second wing creating an even distribution of the downward force;

k. whereby when the container is in a closed condition, a razorblade cartridge containing at least one razorblade having a sharp front edge facing the zinc strip and the razorblade cartridge in-line with the tab and central stabilizer is retained in the interior chamber of the container with the upward orientation of the zinc strip enhancing contact with the razor blade and the center tab and the central stabilizer and left wing and right wing creating an even distribution of downward force on the razorblade cartridge, the handle of the safety razor extending out of the front opening.

2. The container in accordance with claim 1, further comprising: the zinc carrier is removably press fit retained onto the lower interior transverse wall.

3. The container in accordance with claim 1, further comprising: drain holes extending from the bottom interior surface to the bottom exterior surface of the lower section.

4. A container adapted for use with a safety razor having a razorblade cartridge containing at least one razorblade having a front edge, with the container having a top section with an exterior top wall and a bottom section with an exterior bottom wall retained together by a closing force member with the closing force member retained within an interior chamber of the container, the container further comprising;

a. the bottom section including an interior bottom surface and a lower interior transverse wall section affixed within the bottom section, b. a zinc carrier having a vertical wall and a horizontal wall, a zinc strip retained by the horizontal wall;

c. the lower interior transverse wall including at least a transverse top surface, a rear surface and a front surface, affixed to said interior bottom surface at a spaced apart distance from the rear surface of the lower interior transverse wall is at least one zinc carrier retaining wall with a gap between the rear surface of the lower interior transverse wall and the at least one zinc carrier retaining wall;

d. the zinc carrier retained onto the lower interior transverse wall by at least the vertical wall press fit retained in the gap between the at least one zinc carrier retaining wall and the rear surface of the lower interior transverse wall, the horizontal wall resting on the top surface of the lower interior transverse wall;

e. the top section of the container includes an upper interior transverse wall affixed at least to the upper interior surface, a central stabilizer including a central upper interior wing wall extending to a first wing extending to a left upper interior sidewall, the central upper interior wing wall extending to an oppositely disposed second wing extending to a right upper interior sidewall, also incorporated as part of the central stabilizer is a vertical front wall and a vertical rear wall separated by a U-shaped groove, the upper interior transverse wall having a lower ledge with a recessed area, the vertical front wall, the central upper interior wing wall and the vertical rear wall inserted over the central upper interior wall so that the groove aligns with the ledge recessed area, the central interior wing wall is incorporated into a first wall and rests against a front surface of central upper interior transverse wall, a longitudinal wall is incorporated into a front surface of the front wall and extends perpendicularly to the front wall and toward upper section front opening but curves downwardly with a distal arcuate section terminating in a tab with a bottom surface aligned with and extending in the direction of the zinc strip;

e. the vertical rear wall of the central stabilizer retaining wall press fit retained within a gap between the rear surface of the upper interior transverse wall and at least one wing retaining wall; and f. a center tab creating a downward force in the direction of the lower section and the central stabilizer including the central upper interior wing wall extending to the first wing extending to a left upper interior sidewall and the central upper interior wing wall extending to the oppositely disposed second wing extending to the right upper interior sidewall creating an even distribution of the downward force;

g. whereby when the container is in a closed condition, a razorblade cartridge containing at least one razorblade having a front edge facing the zinc strip and the razorblade cartridge in-line with the tab and central stabilizer is retained in the interior chamber of the container with the location of the zinc strip enhancing contact with the razor blade and the center tab and the central stabilizer and left wing and right wing creating an even distribution of downward force on the razorblade cartridge.

5. The container in accordance with claim 4, further comprising: the zinc strip is retained on the horizontal wall of the zinc carrier in a manner causing the zinc strip to be bent into a convex shape with a highest portion of the zinc strip extending towards the tab.

6. The container in accordance with claim 4, further comprising: said zinc carrier is press fit retained onto the lower interior transverse wall.

7. The container in accordance with claim 6, further comprising: said zinc carrier is removably press fit retained onto the lower interior transverse wall.

8. The container in accordance with claim 4, further comprising: drain holes extending from the bottom interior surface to the bottom exterior surface of the lower section.

9. A container used in conjunction with a safety razor having a razorblade cartridge containing at least one razorblade having a front edge, with the container having a top section and a bottom section retained together by a closing force member with the closing force member retained within an interior chamber of the container, the container further comprising;

a. said top section having a central stabilizer with wings and said bottom section having a removably affixed zinc carrier;

b. said central stabilizer with wings having a central tab with a central tab bottom surface, a first wing having a bottom first wing surface, and a second wing having a bottom second wing surface;

c. said central stabilizer with wings having a central stabilizer first wall and a central stabilizer second wall that meet together to form a U-shaped groove that an upper interior transverse wall fits between;

d. said central stabilizer first wall press fit retained between a front surface of the upper interior transverse wall and at least one retaining member spaced apart from the upper interior transverse wall;

e. a lower interior transverse wall including at least a transverse top surface, a rear surface and a front surface, affixed to said interior bottom surface at a spaced apart distance from the rear surface of the lower interior transverse wall is at least one zinc carrier retaining wall with a gap between the rear surface of the lower interior transverse wall and the at least one zinc carrier retaining wall;

f. the zinc carrier retained onto the lower interior transverse wall by at least a vertical wall press fit retained in the gap between the at least one zinc carrier retaining wall and the rear surface of the lower interior transverse wall, the horizontal wall resting on the top surface of the lower interior transverse wall; and g. the central tab aligned with the zinc strip, the central stabilizer functioning as a spring for the tab to exert a downward force relative to the zinc strip and the left and right wings evenly distribution the downward force.

10. The container in accordance with claim 9, further comprising: said zinc strip formed into an upwardly extending convex shape.

11. The container in accordance with claim 9, further comprising: the zinc strip is retained on the horizontal wall of the zinc carrier in a manner causing the zinc strip to be bent into a convex shape with a highest portion of the zinc strip extending towards the tab.

12. The container in accordance with claim 9, further comprising: said zinc carrier is press fit retained onto the lower interior transverse wall.

13. The container in accordance with claim 9, further comprising: said zinc carrier is removably press fit retained onto the lower interior transverse wall.

14. The container in accordance with claim 6, further comprising: said first wing and said second wing are mirror images of each other.

* * * * *